US006494274B1

(12) United States Patent
Murray et al.

(10) Patent No.: US 6,494,274 B1
(45) Date of Patent: Dec. 17, 2002

(54) AXLE, A FRICTION REDUCING FITTING AND AN AXLE INSTALLATION METHOD

(75) Inventors: Geoffrey Neil Murray, Willis, TX (US); Denis Robert Fernandes, New Plymouth (NZ); Peter James Radich, New Plymouth (NZ)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/623,142

(22) PCT Filed: Mar. 4, 1999

(86) PCT No.: PCT/NZ99/00027

§ 371 (c)(1),
(2), (4) Date: Nov. 15, 2000

(87) PCT Pub. No.: WO99/45229

PCT Pub. Date: Sep. 10, 1999

(30) Foreign Application Priority Data

Mar. 5, 1998 (NZ) ..... 329910

(51) Int. Cl.[7] ..... E21B 17/10

(52) U.S. Cl. ..... 175/325.3; 175/325.6

(58) Field of Search ..... 175/325.3, 325.6, 175/325.7; 166/241.6, 241.7; 123/90.48, 90.5

(56) References Cited

U.S. PATENT DOCUMENTS

| | | | | |
|---|---|---|---|---|
| 1,651,088 | A | 11/1927 | Fentress | |
| 1,699,087 | A | 1/1929 | Woodmansee et al. | |
| 1,801,294 | A | 4/1931 | Sutton | |
| 1,831,999 | A | 11/1931 | Bull | |
| 1,913,365 | A | 6/1933 | Bailey | |
| 1,923,328 | A | 8/1933 | Reed | 255/28 |
| 2,601,478 | A | 6/1952 | Weir | 308/6 |
| 2,812,200 | A | 11/1957 | Yeargan | 287/52.09 |
| 2,860,013 | A | 11/1958 | Medearis | 308/4 |
| 2,897,016 | A | 7/1959 | Baker | 308/4 |
| 3,052,310 | A | 9/1962 | Kinzbach | 175/406 |
| 3,054,646 | A | 9/1962 | Minor | 308/4 |
| 3,164,216 | A | 1/1965 | Hall et al. | 175/323 |
| 3,669,190 | A | 6/1972 | Sizer et al. | 166/315 |
| 3,797,592 | A | 3/1974 | Goodfellow | 175/325 |
| 3,894,780 | A | 7/1975 | Broussard | 308/4 A |

(List continued on next page.)

FOREIGN PATENT DOCUMENTS

| | | | |
|---|---|---|---|
| CA | 1 044 220 | 12/1978 | E21B/17/10 |
| EP | 0 333 450 | 9/1989 | E21B/17/10 |
| GB | 2 233 690 | 1/1991 | E21B/17/10 |
| GB | 2 257 447 | 1/1993 | E21B/17/10 |
| RU | 2 012 769 | 5/1994 | E21B/17/10 |
| SU | 976 020 | 11/1982 | E21B/29/10 |
| WO | WO 85/05414 | 12/1985 | F16B/19/10 |

(List continued on next page.)

OTHER PUBLICATIONS

PCT International Search Report from PCT/NZ 99/00027, Dated Jul. 23, 1999.

Derwent Abstract, Accession No.: 96–127722/13, Dated Jul. 9, 1995.

Derwent Abstract, Accession No.: 84/311506/50, Dated Apr. 1984.

Derwent Abstract, Accession No.: 1978–56355A/197831, Dated Oct. 6, 1977.

*Primary Examiner*—William Neuder
(74) *Attorney, Agent, or Firm*—Moser, Patterson & Sheridan, L.L.P.

(57) ABSTRACT

A friction reducing fitting for downhole applications. The fitting has a body portion (3) for securement about a tubular member, the body portion having a pair of apertures (5, 6). A roller (1) is provided, and an axle (4, 11) passing through said roller and said apertures in the body at either end of said roller. The axle is deformed at at least one end to prevent movement of the end of the axle through the aperture in the body.

23 Claims, 1 Drawing Sheet

U.S. PATENT DOCUMENTS

| | | | | | |
|---|---|---|---|---|---|
| 4,013,325 | A | | 3/1977 | Rear | 308/4 A |
| 4,266,578 | A | | 5/1981 | Swain et al. | 138/110 |
| 4,273,372 | A | | 6/1981 | Sheshtawy | 294/86.15 |
| 4,336,637 | A | | 6/1982 | Patterson | 24/249 DP |
| 4,548,284 | A | | 10/1985 | Shinn et al. | 175/346 |
| 4,583,604 | A | | 4/1986 | Greer | 175/346 |
| 4,628,874 | A | * | 12/1986 | Barlow | 123/90.5 |
| 4,796,670 | A | | 1/1989 | Russell et al. | 138/110 |
| 4,913,229 | A | | 4/1990 | Hearn | 166/156 |
| 4,919,205 | A | | 4/1990 | Dollison | 166/241 |
| 4,958,692 | A | | 9/1990 | Anderson | 175/323 |
| 5,099,807 | A | * | 3/1992 | Devine | 123/90.5 |
| 5,170,847 | A | | 12/1992 | Mims, et al. | 166/383 |
| 5,180,010 | A | | 1/1993 | Stout et al. | 166/212 |
| 5,186,264 | A | | 2/1993 | Du Chaffaut | 175/27 |
| 5,409,280 | A | | 4/1995 | Hill | 294/16 |
| 5,580,114 | A | | 12/1996 | Palmer | 394/86.15 |
| 5,676,638 | A | * | 10/1997 | Shefi | 601/124 |
| 5,692,562 | A | | 12/1997 | Squires | 166/68.5 |
| 5,778,976 | A | | 7/1998 | Murray | 166/241.6 |
| 5,901,798 | A | | 5/1999 | Herrera et al. | 175/325.3 |
| 6,050,341 | A | | 4/2000 | Metcalf | 166/383 |
| 6,209,667 | B1 | * | 4/2001 | Murray et al. | 175/323.5 |
| 6,250,406 | B1 | | 6/2001 | Kuke | 175/325.2 |

FOREIGN PATENT DOCUMENTS

| | | | |
|---|---|---|---|
| WO | WO 91/08374 | 6/1991 | E21B/17/10 |
| WO | WO 93/24728 | 12/1993 | E21B/17/10 |
| WO | WO 95/05521 | 2/1995 | E21B/17/10 |
| WO | WO 95/10685 | 4/1995 | E21B/17/10 |
| WO | WO 95/11368 | 4/1995 | E21B/17/10 |
| WO | WO 95/21986 | 8/1995 | E21B/17/10 |
| WO | WO 96/09459 | 3/1996 | E21B/17/10 |
| WO | WO 96/34173 | 10/1996 | E21B/17/10 |
| WO | WO 97/08425 | 3/1997 | E21B/23/00 |
| WO | WO 98/07953 | 2/1998 | E21B/17/10 |
| WO | WO 98/40601 | 9/1998 | E21B/17/10 |
| WO | WO 99/04132 | 1/1999 | E21B/17/10 |

* cited by examiner

AXLE, A FRICTION REDUCING FITTING AND AN AXLE INSTALLATION METHOD

THE TECHNICAL FIELD

The present invention is directed to an axle for retaining rollers within friction reducing fittings used in downhole applications and a method of installing the same. More particularly, but not exclusively, the present invention relates to an axle which is deformed at one or each end to retain the axle.

BACKGROUND OF THE INVENTION

In downhole applications it is important that tools do not fail or, if they do fail, that they do not break in such a manner that parts of the tool are introduced into the well. If the axle supporting a roller fails this can result in the roller and axle being released into the well. In the case of a drilling application this can damage the drill bit or jam the drilling rig in place. Even if this does not happen, the friction reduction will be greatly diminished.

DISCLOSURE OF THE INVENTION

It is thus an object of the invention to provide a friction reducing fitting and an axle and method of installation that is simple and minimises the risk of axle failure or which at least provides the public with a useful choice. According to a first aspect of the invention there is provided a friction reducing fitting for downhole applications comprising:

a body portion for securement about a tubular member, the body portion having a pair of apertures;

a roller; and an axle passing through said roller and said apertures in the body at either end of said roller, wherein the axle is deformed at at least one end to prevent movement of that end of the axle through the aperture in the body.

It has been found that surprisingly the axle can absorb the shock of a high impact load transmitted through the axle by deforming plastically. This means once the load is removed the axle and roller may revert to their original positions and remain secured to the fittings.

Conventionally, axles of the form employed in the present invention are hardened and thus are too brittle to be deformed to any great extent. Therefore, on first consideration, an axle having a deformed end would not be thought to be strong enough. However, it has been found that by only employing a small amount of deformation, an axle of sufficient strength can be formed.

The deformed end of the axle preferably has an enlarged diameter. This enables the deformed end of the axle to be conveniently enlarged by inserting a formation into a cavity formed in the end of the axle. Preferably the cavity and/or the formation are tapered to enable easy deformation.

In one embodiment the axle is deformed at both ends. In an alternative embodiment the axle is deformed at one end only and an enlarged diameter section is preformed at the other end of the axle.

The roller may be employed to reduce friction between the fitting and an internal component passing through the centre of the tubular member. However, the roller is typically located on the exterior of the body portion whereby the roller reduces drag in use between the fitting and a bore hole wall. In this case the invention prevents or at least reduces the chances of the roller being released into the bore hole.

The apertures in the body portion may be formed in a pair of ears extending from the body portion. Alternatively the body portion may have a cavity formed therein to accommodate the roller.

The deformation of the end of the axle may prevent movement of that end through the aperture away from the roller. However in a preferred embodiment the deformation of the end of the axle prevents movement of that end through the aperture in the body towards the roller (i.e. in the case where a cavity is provided in the body portion, movement towards the cavity is restricted).

In a preferred embodiment the roller has a bore which receives the axle, and the bore has portions of increased diameter at each end to form a pair of corresponding recesses between the axle and the roller. This prevents undue shear force being placed on the axle at the ends of the roller.

There is also provided a downhole device comprising a tubular member, and a fitting according to the first aspect of the present invention secured to the tubular member.

The fitting may be employed in a variety of down hole applications. For instance, the tubular member may comprise a drill string employed in the drilling of the bore hole. In this case the fitting typically reduces friction between the drill string and the wall of a borehole as described in WO 96/34173. Alternatively, the fitting may comprise a centraliser, float shoe or float collar as described in WO 95/21986. In a further alternative, the fitting may be employed in a post-drilling downhole operation, such as NMR well logging.

There is further provided an axle for securing a roller to a fitting for reducing friction in downhole applications, the axle comprising a cylindrical body section having a cavity formed at at least one end which is dimensioned to facilitate deformation of that end of the axle to retain it in position in use.

Both ends of the axle may be provided with such cavities or an enlarged diameter section may be preformed at one end of the axle. The or each cavity may be tapered, for instance frustoconical.

There is further provided a method of securing a roller to a fitting for reducing friction in downhole applications comprising:

positioning a roller so that the ends of the roller are proximate apertures in a body of the fitting; inserting an axle through the apertures in the body and bore in the roller; and deforming at least one end of the axle to prevent that end from moving through the adjacent aperture in the body in use.

BRIEF DESCRIPTION OF DRAWINGS

The invention will now be described by way of example with reference to the accompanying drawings in which.

DETAILED DESCRIPTION OF THE PREFERRED EMBODIMENTS

The friction reducing tool hereinafter described is of the type described in WO 95/21986 and WO 96134173 and reference should be made to these documents for a better understanding of the type of tool concerned.

Figure 1:
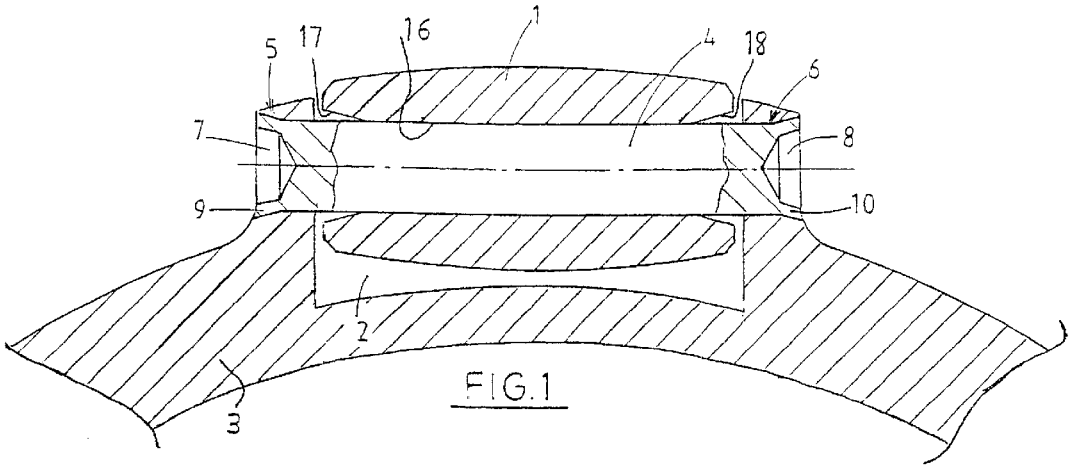
FIG. 1 shows a cross sectional view through a friction reducing fitting having a roller secured thereto by an axle according to one embodiment of the invention.

Referring to FIG. 1, a roller 1 is seen to be located within a cavity 2 of a body part 3 of a friction reducing fitting.

Roller 1 is retained in place by axle 4 which is received in a bore 16 in the roller and which is located within apertures 5 and 6 of body 3. The ends of axle 4 have cavities 7 and 8 drilled therein. The bore 16 has enlarged diameter frusto-conical portions 17, 18 formed at each end. The corresponding recesses formed between the axle and roller ensure that undue shear force is not placed on the axle at the ends of the roller.

Figure 2:
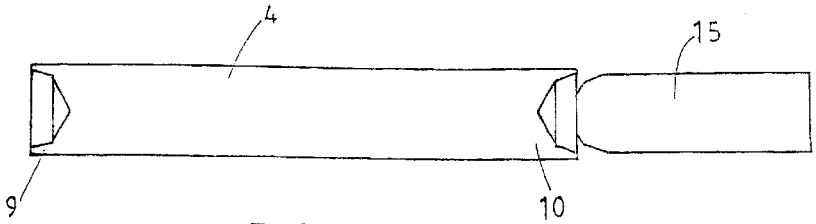
FIG. 2 shows the axle shown in FIG. 1 prior to deformation.

Referring now to FIG. 2 the axle 4 is shown prior to installation. It will be seen that the external diameter of axle 4 is constant along its length, including at each end. In use roller 1 is placed within cavity 2 and undeformed axle 4 (see FIG. 2) is slid through apertures 5 and 6 and the interior bore of roller 1. When in position a conical formation 15 may be forced into cavities 7 and 8 to splay ends 9 and 10 as shown in FIG. 1. This may be achieved by forcing conical formation 15 into cavities 7 and 8 under the force of a hydraulic ram etc. It will be appreciated that one end may be deformed in this manner prior to insertion and the other end deformed in situ or both ends may be deformed in situ. It will also be appreciated that other forms of deformation may be used to increase the diameter of the ends 9 and 10 of axle 4.

Figure 3:
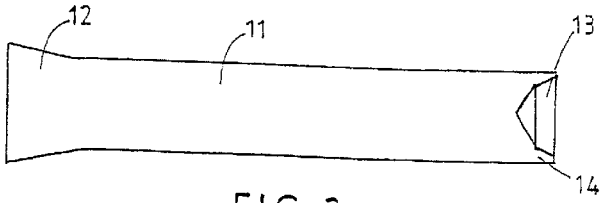
FIG. 3 shows an axle according to an alternative embodiment of the invention prior to deformation of one end of the axle.

Referring now to FIG. 3 an alternative embodiment is shown in which axle 11 is seen to have a flanged end 12 dimensioned to be accommodated within aperture 5 or 6. The other end has a cavity 13 of the type described above. With this embodiment the pin is inserted through the apertures 5 and 6 and bore of roller 1 and then end 14 is deformed in the manner described above to retain the axle in place. The axle is preferably formed of AISI 4140 carbon steel.

It has been found that this technique simplifies manufacture in that expensive and time consuming welding is not required. This construction also provides good axle retention with a force in excess of 4000 pounds being required to dislodge the axle in tests conducted by the applicant.

The axles 4,11 shown in FIGS. 1–3 are hardened, e.g. they may be nitrocarburized, nitrided, case or induction hardened. Previously, hardened materials have not been considered suitable for deformation since the case hardening makes them brittle and hence liable to break. However it has been found that the axles 4,11 may be deformed a small amount (i.e. sufficient to retain them securely) without breaking.

In use, when the roller 1 receives a high impact load, each deformed end of the axle 4,11 contracts into its respective cavity 7,8,13 thus allowing the end(s) of the axle 4,11 to be pulled inwards through their respective apertures 5,6. Under extreme loads deformed ends 9 and 10 may deform inwardly to enable the ends 9 and 10 to move towards roller 1. This enables the axle 4,11 to bend inwards and absorb the impact without excessive shear loading.

Where in the foregoing description reference has been made to integers or components having known equivalents then such equivalents are herein incorporated as if individually set forth.

Although this invention has been described by way of example it is to be appreciated that improvements and/or modifications may be made thereto without departing from the scope or spirit of the present invention.

What is claimed is:

1. A friction reducing fitting for downhole applications comprising: a body portion for securement about a tubular member, the body portion having a pair of apertures;

a roller; and an axle passing through said roller and said apertures in the body at either end of said roller, wherein the axle is deformed at at least one end to prevent movement of the end of the axle through the aperture in the body and wherein the deformed end of the axle has a cavity which is dimensioned to facilitate deformation of that end of the axle.

2. A fitting according to claim 1 wherein each deformed end of the axle has an enlarged diameter.

3. A fitting according to claim 1 wherein the cavity in the axle has tapered sides.

4. A fitting according to claim 1 wherein both ends of the axle are deformed to prevent movement of each end of the axle through the apertures in the body.

5. A fitting according to claim 1 wherein only one end of the axle is deformed and the other end of the axle is preformed with an enlarged diameter section.

6. A fitting according to claim 1 wherein the roller is located on the exterior of the body portion whereby the roller reduces drag in use between the fitting and a borehole wall.

7. A fitting according to claim 1 wherein the body portion has a cavity therein to accommodate the roller.

8. A fitting according to claim 1 wherein the deformation of the end of the axle prevents movement of that end through the aperture in the body towards the roller.

9. A fitting according to claim 1 wherein the roller has a bore which receives the axle, and wherein the bore has portions of increased diameter at each end to form a pair of corresponding recesses between the axle and the roller.

10. A downhole device comprising a tubular member, and a fitting according to claim 1 secured to the tubular member.

11. A device according to claim 10 wherein the fitting is removably secured to the tubular member.

12. A device according to claim 10 wherein the tubular member comprises a drill string.

13. A device according to claim 10 wherein the tubular member comprises a drill casing.

14. An axle for securing a roller to a friction reducing fitting for downhole applications, the axle comprising a cylindrical body section having a cavity formed at at least one end which is dimensioned to facilitate deformation of that end of the axle to retain it in position in use.

15. An axle according to claim 14 wherein the or each cavity has tapered sides.

16. An axle according to claim 14 wherein the axle has a cavity formed at each end.

17. An axle according to claim 14 wherein the axle has a cavity at one end only and the other end of the axle is preformed with an enlarged diameter section.

18. An axle according to any of claim 14 wherein the axle is hardened.

19. A method of securing a roller to a fitting for reducing friction in downhole applications, the method comprising: positioning a roller so that the ends of the roller are proximate apertures in a body of the fitting; forming a recess between an axle and a bore in the roller; inserting the axle through the apertures in the body and the bore in the roller; and deforming at least one end of the axle by inserting a formation into a cavity formed in the end of the axle to prevent that end from moving through the adjacent aperture in the body in use.

20. A method according to claim 19 wherein the step of deforming the end of the axle enlarges the diameter of that end of the axle.

21. A friction reducing fitting for downhole applications comprising: a body portion for securement about a tubular member, the body portion having a pair of apertures;

a roller having a bore which receives an axle, and wherein the bore has enlarged diameter portions formed at each end; and said axle passing through said roller and said apertures in the body at either end of said roller, wherein the axle is deformed at at least one end to prevent movement of the end of the axle through the aperture in the body.

22. The friction reducing fitting of claim 21 wherein the enlarged diameter portions formed at each end of the roller are frustoconical.

23. The friction reducing fitting of claim 21 further comprising corresponding recesses between the axle and the enlarged diameter portions at each end of the axle.

* * * * *